US011073347B2

(12) United States Patent
Manenti

(10) Patent No.: US 11,073,347 B2
(45) Date of Patent: Jul. 27, 2021

(54) SHELL-AND-TUBE EQUIPMENT WITH BYPASS

(71) Applicant: ALFA LAVAL OLMI S.P.A, Suisio (IT)

(72) Inventor: Giovanni Manenti, Castelli Calepio (IT)

(73) Assignee: ALFA LAVAL OLMI S.P.A., Suisio (IT)

( * ) Notice: Subject to any disclaimer, the term of this patent is extended or adjusted under 35 U.S.C. 154(b) by 72 days.

(21) Appl. No.: 16/616,700

(22) PCT Filed: Mar. 7, 2018

(86) PCT No.: PCT/EP2018/055624
§ 371 (c)(1),
(2) Date: Nov. 25, 2019

(87) PCT Pub. No.: WO2018/215102
PCT Pub. Date: Nov. 29, 2018

(65) Prior Publication Data

US 2021/0148659 A1 May 20, 2021

(30) Foreign Application Priority Data

May 26, 2017 (EP) ..... 17425055

(51) Int. Cl.
*F28F 27/00* (2006.01)
*F28F 27/02* (2006.01)
(Continued)

(52) U.S. Cl.
CPC ..... *F28F 27/02* (2013.01); *F28D 7/0083* (2013.01); *F28D 7/106* (2013.01); *F28D 7/1607* (2013.01);
(Continued)

(58) Field of Classification Search
CPC ..... F28F 27/02; F28F 2250/06; F28D 7/0083; F28D 7/106; F28D 7/1607; F28D 2021/0022
(Continued)

(56) References Cited

U.S. PATENT DOCUMENTS 4,294,312 A 10/1981 Kehrer et al.
4,449,569 A 5/1984 Lisi et al.
(Continued)

FOREIGN PATENT DOCUMENTS

CN 105492828 A 4/2016
CN 205425903 U 8/2016
(Continued)

OTHER PUBLICATIONS

An English Translation of the First Office Action dated Oct. 19, 2020, by the State Intellectual Property Office of People's Republic of China in corresponding Chinese Patent Application No. 201880050476.2. (11 pages).
(Continued)

*Primary Examiner* — Davis D Hwu
(74) *Attorney, Agent, or Firm* — Buchanan Ingersoll & Rooney PC

(57) ABSTRACT

A shell-and-tube equipment comprises an inlet channel for a first fluid to be cooled, an outlet channel for the cooled first fluid, a plurality of tube-bundle tubes, at least a tube-sheet, a shell enclosing the tube-bundle tubes and a bypass system for controlling the outlet temperature of the cooled first fluid at a target value. The bypass system comprises a box installed inside the outlet channel. The box is provided with an opening or conduit, a regulating valve and a box tube-sheet. The box is further provided with bypass bayonet tubes. Each bayonet tube extends from the box tube-sheet to a point in between a first open end and a second open end
(Continued)

of the tube-bundle tubes and is partially inserted into a corresponding tube-bundle tube, so as an annular gap in between each tube-bundle tube and the corresponding bayonet tube is formed.

16 Claims, 7 Drawing Sheets

(51) Int. Cl.
*F28D 7/00* (2006.01)
*F28D 7/10* (2006.01)
*F28D 7/16* (2006.01)
*F28D 21/00* (2006.01)

(52) U.S. Cl.
CPC .. *F28D 2021/0022* (2013.01); *F28F 2250/06* (2013.01)

(58) Field of Classification Search
USPC ..... 165/96
See application file for complete search history.

(56) References Cited

U.S. PATENT DOCUMENTS

| | | | | |
|---|---|---|---|---|
| 4,991,643 | A | 2/1991 | Price et al. | |
| 5,452,686 | A | 9/1995 | Stahl | |
| 5,852,990 | A | 12/1998 | Primdahl | |
| 10,663,230 | B2 * | 5/2020 | Dahl | F28F 9/26 |
| 2007/0125317 | A1 | 6/2007 | Jekerle et al. | |
| 2013/0180475 | A1 | 7/2013 | Christiansen | |
| 2015/0004552 | A1 | 1/2015 | Kang | |
| 2015/0159861 | A1 | 6/2015 | Heinesen et al. | |
| 2016/0334175 | A1 | 11/2016 | Eckert et al. | |
| 2018/0238628 | A1 * | 8/2018 | Dahl | F28D 7/16 |

FOREIGN PATENT DOCUMENTS

| | | | |
|---|---|---|---|
| DE | 28 46 455 | B1 | 10/1979 |
| DE | 102005057674 | A1 | 6/2007 |
| DE | 102011118164 | A1 | 7/2012 |
| DE | 102012007721 | A1 | 10/2013 |
| DE | 10 2014 201 908 | A1 | 8/2015 |
| DE | 102015212433 | A1 | 1/2017 |
| EP | 0233997 | A1 | 9/1987 |
| EP | 0617230 | A1 | 9/1994 |
| EP | 0690262 | A1 | 1/1996 |
| EP | 1498678 | A1 | 1/2005 |
| EP | 1519134 | A2 | 3/2005 |
| EP | 1724544 | A1 | 11/2006 |
| FR | 2 507 299 | A1 | 12/1982 |
| GB | 2036287 | A | 6/1980 |
| JP | S57-172111 | A | 10/1982 |
| JP | S60-186691 | A | 9/1985 |
| JP | S62-293089 | A | 12/1987 |
| JP | H04-098099 | A | 3/1992 |
| JP | 2015114043 | A | 6/2015 |
| KR | 10-2016-0025570 | A | 3/2016 |
| RU | 4157 | U1 | 5/1997 |
| RU | 32544 | C2 | 2/2001 |
| SU | 1688098 | A1 | 10/1991 |
| WO | 9012993 | A1 | 11/1990 |
| WO | 2012041344 | A1 | 4/2012 |
| WO | 2013167180 | A1 | 11/2013 |
| WO | 2016135299 | A1 | 9/2016 |

OTHER PUBLICATIONS

Office Action (First Examination Report) dated Jan. 29, 2021, by the Patent Office, Government of India, in corresponding India Patent Application No. 201917053556 with an English Translation of the Office Action. (6 pages).

ARVOS Brochure, Syngas Cooler Systems for Gasification Plant, Schmidtsche Schack, 20 pages, 2015.

International Search Report (PCT/ISA/210) dated Jun. 14, 2018, by the European Patent Office as the International Searching Authority for International Application No. PCT/EP2018/055624.

Written Opinion (PCT/ISA/237) dated Jun. 14, 2018, by the European Patent Office as the International Searching Authority for International Application No. PCT/EP2018/055624.

An English Translation of the Office Action (Decision to Grant) and Search Report dated May 25, 2020, by the Federal Service for Intellectual Property (Rospatent) in corresponding Russian Patent Application No. 2019143753/(084785). (10 pages).

An English Translation of the Office Action (Notice of Preliminary Rejection) dated Feb. 10, 2021, by the Korean Intellectual Property Office in corresponding Korean Patent Application No. 10-2019-7038180. (4 pages).

* cited by examiner

SHELL-AND-TUBE EQUIPMENT WITH BYPASS

BACKGROUND OF THE INVENTION

The present invention refers to a shell-and-tube equipment and, more specifically, to a process gas cooler or PGC.

Process gas coolers are special heat exchangers installed downstream of chemical reactors. A process gas cooler receives a process gas at high temperature and pressure and provides for gas cooling by means of a cooling fluid, which can be vaporizing water, sub-cooled water, steam or any other liquid or gas. Often, the process gas contains chemical species that can corrode or attack standard construction steels at high temperature and pressure, like carbon monoxide, hydrogen and ammonia. Some examples of process gases are the ones discharged from steam methane reforming reactors, auto-thermal reforming reactors, high-temperature water-shift reactors and ammonia synthesis reactors.

Most number of process gas coolers are shell-and-tube type heat exchangers, with tubes of straight or U-shaped type, and with an installation that can be vertical or horizontal. The hot process gas can be allocated either on tube-side or on shell-side. If the gas flows on tube-side, the cooling fluid flows on shell-side; in case the cooling fluid is vaporizing water, it preferably flows under natural circulation. Due to the severe and specific service, process gas coolers have frequently a design characterized by special tube-bundle layouts, shell-side baffles configurations and construction materials.

Since the process gas undergoes chemical syntheses, the gas temperature at the process gas cooler outlet must be often kept at a constant value. As a consequence, a major operating issue of many process gas coolers is to control the gas outlet temperature against fluctuations of the heat exchange performance. For instance, fouling growth on exchanging surfaces can significantly increase the heat transfer resistance, and therefore the cooling of process gas is reduced. Also, changes of load and turndown operations can lead to a depart from nominal operating conditions, with an impact on gas outlet temperature. Finally, unscheduled issues on upstream and downstream equipment can force the equipment to work at different operating conditions.

When the outlet gas temperature must be controlled, the process gas cooler is usually equipped with a bypass system that allows bypassing a portion of the process gas, so as to modify the amount of transferred heat to cooling fluid. Accordingly, the hot process gas is split into two flows arranged in parallel. One flow ("bypass flow") does not participate, or incompletely participates, to the heat exchange, whereas the other flow ("main flow") participates to the heat exchange. After the heat exchange, the two flows are at different temperatures, and are recombined and mixed. If the temperature of the combined flow, or the outlet process gas, is not at the target value, the bypass system allows modifying the amount of the main flow and the bypass flow respectively.

In FIGS. 1 and 2 two typical process gas coolers with process gas on tube-side and a bypass system are shown. These process gas coolers represent the prior art in the respective technical field.

The process gas cooler 100 comprises an inlet channel 102, where the hot process gas 104 enters into the process gas cooler 100, an outlet channel 106, where the cooled process gas 108 exits from the process gas cooler 100, an inlet tube-sheet 110, hydraulically connected to the inlet channel 102, and an outlet tube-sheet 112, hydraulically connected to the outlet channel 106. The process gas cooler 100 also comprises a plurality of tubes 114, connected at their ends to the tube-sheets 110 and 112 and putting in communication the inlet 102 and outlet 106 channels, and a shell 116, enclosing the tubes 114 and connected to the inlet 110 and outlet 112 tube-sheets. In an alternative, possible arrangement, the shell 116 could be connected to the inlet 102 and outlet 106 channels. In this case, the inlet 110 and outlet 112 tube-sheets are either respectively connected to the inlet 102 and outlet 106 channels or to the shell 116. A plurality of inlet nozzles 118 and outlet nozzles 120 are provided for the tube-side, whereas a plurality of inlet and outlet nozzles 122 are provided for the shell-side.

The bypass system of the process gas cooler 100 shown in FIG. 1 comprises a bypass tube 124 with an internal insulating material 126, comprised in the shell 116 and connected at its ends to the inlet 110 and outlet 112 tube-sheets. A wall 128 is comprised in the outlet channel 106, which is provided with at least one first conduit or opening 130 and divides the outlet channel 106 in two chambers 132 and 134. A pipe extension 136 of the bypass tube 124 is housed in the outlet channel 106. The pipe extension 136 extends from the outlet tube-sheet 112 until to or beyond the dividing wall 128 and is provided with at least one second opening 138. A first regulating valve 140 for the process gas main flow 142 flowing in the tubes 114 is provided in the outlet channel 106 and, more specifically, is installed on a respective conduit or opening 130. A second regulating valve 144 for the process gas bypass flow 146 flowing in the bypass tube 124 is also provided in the outlet channel 106 and, more specifically, is installed on the pipe extension 136, preferably on the second opening 138.

A process gas cooler 100 as shown in FIG. 1 can be provided with different bypass system configurations. For instance, the dividing wall 128, the first openings 130 and the first regulating valves 140 can be absent and therefore only the bypass tube 124, the pipe extension 136 and the second regulating valve 144 are installed in the process gas cooler 100.

According to the prior art shown in FIG. 1, the hot process gas 104 in the inlet channel 102 splits into two flows: the inlet main flow 142, which enters in the tubes 114, and the bypass flow 146, which enters in the bypass tube 124. The inlet main flow 142 indirectly exchanges heat with the cooling fluid circulating on the shell-side and therefore at the outlet of tubes 114 the outlet main flow 148 is cold. On the contrary, the bypass flow 146 does not exchange, or minorly exchanges, heat with the cooling fluid, since the insulating material 126 installed in the bypass tube 124 acts as a heat transfer barrier. As a consequence, the two flows 146 and 148 have a different temperature at the outlet of tubes 114, and specifically the outlet main flow 148 is colder than the bypass flow 146.

The amounts of outlet main flow 148 and bypass flow 146 are determined by the opening of the regulating valves 140 and 144. Since the regulating valves 140 and 144 are distinctly installed on the two flows 146 and 148, the regulating valves 140 and 144 preferably act according to a complementary logic. When the first regulating valve 140 opens, the second regulating valve 144 closes, and vice versa.

The cooled main flow 148 at the outlet of tubes 114 is discharged into the chamber 132. This outlet main flow 148 is not in direct contact with the bypass flow 146. The outlet main flow 148 thus moves from chamber 132 to chamber 134, across the first opening 130 and the first regulating valve 140. Then, the outlet main flow 148 is discharged into the chamber 134. The bypass flow 146 flows along the bypass tube 126 and the pipe extension 136, then it crosses the second opening 138 and the second regulating valve 144. The bypass flow 146, hotter than the outlet main flow 148, is discharged into the chamber 134.

In the chamber 134, the outlet main flow 148 and the bypass flow 146 are in direct contact, mix together and the combined process gas 108 exits from the process gas cooler 100 by the outlet nozzle 120. The temperature of the outlet process gas 108 is measured close to the outlet nozzle 120. If the outlet gas temperature is not at the target value, positions of regulating valves 140 and 144 are adjusted and subsequently the amounts of main and bypass flows are adjusted. The adjustment of the flows amounts has an impact on the overall heat transferred from process gas to cooling fluid, and therefore on the outlet gas temperature. The adjustment proceeds until the target temperature at the outlet nozzle 120 is reached.

The process gas cooler 200 shown in FIG. 2 comprises an inlet channel 202, where the hot process gas 204 enters into the process gas cooler 200 by a plurality of inlet nozzles 218, and an outlet channel 206, where the cooled process gas 208 exits from the process gas cooler 200 by a plurality of outlet nozzles 220. The outlet channel 206 and the inlet channel 202 are arranged in order that the outlet channel 206 encloses the inlet channel 202. The process gas cooler 200 also comprises a tube-sheet 212, hydraulically connected to the inlet channel 202 and to the outlet channel 206, a plurality of U-shaped tubes 214, connected at their ends to the tube-sheet 212, and a shell 216, enclosing the tubes 214 and connected to the tube-sheet 212 on the opposite side of the outlet channel 206. The shell 216 is provided with a plurality of inlet and outlet nozzles 222. The tubes 214 are in fluid communications with the inlet channel 202 at one end, and with the outlet channel 206 at the other end.

The bypass system of the process gas cooler 200 shown in FIG. 2 comprises a bypass conduit or opening 238 installed on the inlet channel 202 and enclosed into the outlet channel 206. A wall 228 is comprised in the outlet channel 206, which is provided with at least one first opening 230 and divides the outlet channel 206 in two chambers 232 and 234. The bypass conduit or opening 238 extends from the inlet channel 202 until to or beyond the dividing wall 228. A first regulating valve 240 for the process gas main flow 242 flowing in the tubes 214 is provided in the outlet channel 206 and, more specifically, is installed on a respective conduit or opening 230. A second regulating valve 244 for the process gas bypass flow 246 flowing in the bypass conduit or opening 238 is also provided in the outlet channel 206.

A process gas cooler 200 as the one shown in FIG. 2 can be provided with different bypass system configurations. For instance, the dividing wall 228, the first openings 230 and the first regulating valves 240 can be absent and therefore only the bypass conduit or opening 238 is installed in the process gas cooler 200.

According to the prior art shown in FIG. 2, the hot process gas 204 in the inlet channel 202 splits into two flows: the inlet main flow 242, which enters in the tubes 214, and the bypass flow 246, which enters in the bypass conduit or opening 238. The inlet main flow 242 indirectly exchanges heat with the cooling fluid circulating on the shell-side and therefore at the outlet of tubes the outlet main flow 248 is cold. On the contrary, the bypass flow 246 does not exchange heat with the cooling fluid. As a consequence, the two flows 246 and 248 have a different temperature in the outlet channel 206, and specifically the outlet main flow 248 is colder than the bypass flow 246. Path, mixing and combination of the outlet main flow 248 and the bypass flow 246, and relevant logic control for the temperature of the outlet process gas 208, are similar to the ones described for the process gas cooler shown in FIG. 1.

Several embodiments of process gas coolers similar to prior art of FIGS. 1 and 2 have been disclosed. These embodiments cover shell-and-tube heat exchangers with bypass, specifically for cooling a hot process gas. For example, document WO 90/12993 discloses a bypass system constituted of a bypass tube comprised in the shell, a control device for the bypass flow and a box for collecting the main flow comprised in the outlet channel. Document WO 90/12993 describes different types of control devices for the bypass flow and also a control device for the main flow.

Document WO 2012/041344 describes a box with a regulating valve, installed in the outlet channel, collecting both the bypass flow and a portion of the main flow. The two flows mix in the box before reaching the regulating valve. The mixed flow, after crossing the valve, recombines with the remaining portion of the main flow in the outlet channel.

Document GB 2036287 describes a plug type regulating valve for controlling the amount of the bypass flow and a wall for mixing bypass and main flows, installed in the outlet channel. Document EP 1498678 discloses a bypass system constituted of a bypass tube enclosed in the shell and provided, in the outlet channel, with a guide tube where a piston moves along the axis of the guide tube, closing and freeing the bypass tube cross-section.

Document EP 0617230 describes a heat exchanger for cooling a hot process gas flowing in tubes wherein two different tube-bundles are enclosed in the same shell, and each tube-bundle has its control device installed in the outlet channel. The indirect heat exchange between tube-side process gas and shell-side cooling water is different for the two bundles and adjustable by the control devices which allow changing the amount of the process gas flowing in the two bundles.

Document EP 0690262 discloses a bypass system including an insulated bypass tube and a nozzle in the outlet channel that injects a fluid towards the end of the bypass tube, so as to control the amount of the bypass flow. Document WO 2013/167180 discloses a bypass system with at least one bypass tube enclosed in the shell and, in the outlet channel, two ducts convoying respectively the bypass and main flows to a swirl mixer.

Document U.S. Pat. No. 4,294,312 describes a shell-and-tube heat exchanger for the indirect cooling of a high temperature medium flowing in tubes by a cooling medium flowing in shell. The heat exchanger is constituted of an inlet and outlet tube-sheet which the tubes are connected to at their ends, and inlet and outlet channels connected to inlet and outlet tube-sheets, respectively. The heat exchanger is characterized by an intermediate tube-sheet, or a third tube-sheet, installed in the inlet channel and by insert tubes concentrically inserted into the tubes, so as to form an annular space in between the tubes and the insert tubes for the whole length of the tubes. Such insert tubes are connected to the intermediate tube-sheet and extend beyond the inlet and outlet tube-sheets, into the respective channels. The hot medium injected into the inlet channel enters into the insert tubes and flows along the insert tubes without direct contact with the tubes, which are cooled on the shell-side by the cooling medium. As a result, the heat loading at the inlet tube-sheet and inlet portion of tubes is reduced. The inlet hot medium flowing along the insert tubes, with a small or moderate heat exchange, at outlet of the insert tubes can be either bypassed with a device installed in the outlet channel, or have a U-turn and flow in the annular space in the opposite direction with regard to the flow in the insert tubes.

Document US 2015/0004552 describes a shell-and-tube heat exchanger for an indirect heat exchange between a hot medium flowing on shell-side and a cooling medium flowing on tube-side according to a counter-current configuration, provided with a bypass system. As per FIG. 2 and FIG. 3 of US 2015/0004552, the bypass system is constituted of a bypass inlet plenum and a main inlet plenum receiving, respectively, the bypass flow and the main flow coming from an upstream control valve, installed outside the exchanger body, which splits the inlet, cold tube-side medium into the two flows. The bypass inlet plenum terminates at a first tube-sheet which bypass tubes are connected to. The main inlet plenum terminates at a second tube-sheet which the main tubes are connected to and the main inlet plenum is connected to the first tube-sheet, so as to sealingly surround the bypass tubes in between the first and second tube-sheets. The bypass tubes are concentrically inserted into the main tubes, for a partial length of the main tubes, so as to form an annular space in between the main tubes and the bypass tubes. The bypass tubes have their end inside the main tubes open, so as to be in communication with the main tubes. The main tubes terminates, beyond the bypass tubes, at an outlet section. The cold bypass flow coming from the control valve is injected into the bypass inlet plenum and then flows inside the bypass tubes. The cold main flow coming from the control valve is injected into the main inlet plenum and then flows in the annular space in between the main and bypass tubes. The cold main flow in the annular space is in direct contact with the main tubes which, on the shell-side, are in direct contact with the hot medium. On the contrary, the cold bypass flow flowing in the bypass tubes is not in direct contact with the main tubes. As a consequence, the cold main flow flowing in the annular space has a heat exchange larger than the heat exchange of the cold bypass flow. The two flows recombine at the end of the bypass tubes, mix together and the combined flow moves along the remaining portion of the main tubes, where the remaining heat exchange with the shell-side hot medium occurs. At the outlet of the main tubes, if the combined flow temperature is not at the target value, the upstream splitting valve is adjusted, so as to change the amount of the bypass and main flows and subsequently to change the heat transferred from the shell-side to the tube-side.

SUMMARY OF THE INVENTION

One object of the present invention is therefore to provide a shell-and-tube equipment with bypass which is capable of resolving the drawbacks of the prior art in a simple, inexpensive and particularly functional manner.

In detail, one object of the present invention is to provide a shell-and-tube equipment with bypass wherein no bypass tubes are installed in the respective shell, outside the tubes of the tube-bundle, and therefore the resulting shell internal diameter can be reduced.

Another object of the present invention is to provide a shell-and-tube equipment with bypass wherein the bypass flow is pre-cooled in the tube-bundle, so that the whole bypass system works in colder conditions, and corrosion due to process gas is greatly reduced.

A further object of the present invention is to provide a shell-and-tube equipment with bypass wherein the bypass components are entirely enclosed in the shell-and-tube equipment body, so that they should not be classified as pressure parts.

Still another object of the present invention is to provide a shell-and-tube equipment with bypass wherein the bypass system can be easily removed outside the shell-and-tube equipment for a full inspection and maintenance.

These objects are achieved according to the present invention by providing a shell-and-tube equipment with bypass as well as a method of controlling the outlet temperature from a shell-and-tube equipment with bypass as set forth in the attached claims.

Specifically, these objects are achieved by a shell-and-tube equipment comprising:

- at least an inlet channel, provided with at least a tube-side inlet nozzle for inletting a first fluid;
- at least an outlet channel, provided with at least a tube-side outlet nozzle for outletting the first fluid;
- a plurality of tube-bundle tubes having a first open end in fluid communication with the inlet channel and a second open end in fluid communication with the outlet channel;
- at least a tube-sheet connected to the second open ends of said plurality of tubes;
- a shell sealingly enclosing a chamber around the tube-bundle tubes, wherein said shell is provided with at least a shell-side inlet nozzle, for inletting a second fluid in said chamber, and with at least a shell-side outlet nozzle, for outletting said second fluid from said chamber after indirect heat exchange with said first fluid through said tube-bundle tubes; and
- a bypass system for controlling the outlet temperature of the first fluid at a target value.

The bypass system comprises:

- at least a box installed inside the outlet channel, said box being provided with at least an opening or conduit, a regulating valve and a box tube-sheet;
- a plurality of bypass bayonet tubes in fluid communication with the box through the box tube-sheet, wherein each bayonet tube extends from the box tube-sheet to a point in between the first open end and the second open end of the tube-bundle tubes and is partially inserted into a corresponding tube-bundle tube, so as an annular gap in between each tube-bundle tube and the corresponding bayonet tube is formed, whereby the first fluid flow, depending on the position of said regulating valve, is split into a main flow flowing in said annular gap, and a bypass flow, flowing in said bayonet tubes, and said main flow is discharged from said tube-bundle tubes at a first temperature value, whereas said bypass flow is discharged from said bypass system at a second temperature value that is different from the first temperature value.

In one embodiment, the first fluid is a first fluid to be cooled, the second fluid is a second cooling fluid and the second temperature value is higher than the first temperature value. This implies that the tube-side inlet nozzle is for inletting a first fluid to be cooled, the tube-side outlet nozzle is for outletting the cooled first fluid, the bypass system is for controlling the outlet temperature of the cooled first fluid at a target value. Distinctly, this implies that the above objects are achieved by a shell-and-tube equipment comprising:

- at least an inlet channel, provided with at least a tube-side inlet nozzle for inletting a first fluid to be cooled;
- at least an outlet channel, provided with at least a tube-side outlet nozzle for outletting the cooled first fluid;

a plurality of tube-bundle tubes having a first open end in fluid communication with the inlet channel and a second open end in fluid communication with the outlet channel;

at least a tube-sheet connected to the second open ends of said plurality of tubes;

a shell sealingly enclosing a chamber around the tube-bundle tubes, wherein said shell is provided with at least a shell-side inlet nozzle, for inletting a second cooling fluid in said chamber, and with at least a shell-side outlet nozzle, for outletting said second cooling fluid from said chamber after indirect heat exchange with said first fluid through said tube-bundle tubes; and a bypass system for controlling the outlet temperature of the cooled first fluid at a target value.

The bypass system comprises:

at least a box installed inside the outlet channel, said box being provided with at least an opening or conduit, a regulating valve and a box tube-sheet;

a plurality of bypass bayonet tubes in fluid communication with the box through the box tube-sheet, wherein each bayonet tube extends from the box tube-sheet to a point in between the first open end and the second open end of the tube-bundle tubes and is partially inserted into a corresponding tube-bundle tube, so as an annular gap in between each tube-bundle tube and the corresponding bayonet tube is formed, whereby the first fluid flow, depending on the position of said regulating valve, is split into a main flow flowing in said annular gap, and a bypass flow, flowing in said bayonet tubes, and said main flow is discharged from said tube-bundle tubes at a first temperature value, whereas said bypass flow is discharged from said bypass system at a second temperature value that is higher than the first temperature value.

These objects are also achieved by a method of controlling the outlet temperature of a first fluid from a shell-and-tube equipment at a target value by means of a bypass system. The method comprises:

inletting a first fluid into an inlet channel by a tube-side inlet nozzle provided on the inlet channel, distributing the first fluid into a plurality of tube-bundle tubes having a first open end in fluid communication with the inlet channel and a second open end in fluid communication with an outlet channel, which second open end is connected to a tube-sheet, splitting the first fluid, depending on the position of a regulating valve, into a bypass flow flowing in a plurality of bypass bayonet tubes of the bypass system and a main flow flowing in an annular gap formed in between each tube-bundle tube and the corresponding bypass bayonet tube, the bypass system comprising a box provided with an opening or conduit, the regulating valve and a box tube-sheet, wherein each bayonet tube extends from the box tube-sheet to a point in between the first open end and the second open end of the tube-bundle tubes and is partially inserted into a corresponding tube-bundle tube, the plurality of bypass bayonet tubes being in fluid communication with the box through the box tube-sheet, the box being installed inside the outlet channel, inletting a second fluid in a chamber around the tube-bundle tubes by a shell-side inlet nozzle provided on a shell sealingly enclosing the chamber, outletting the second fluid from the chamber by a shell-side outlet nozzle provided on the shell after indirect heat exchange with the first fluid through the tube-bundle tubes, discharging the main flow from the annular gap of the tube-bundle tubes into the outlet chamber at a first temperature value, discharging the bypass flow from the bypass system into the outlet chamber at a second temperature value that is different from the first temperature value, outletting the first fluid from the outlet channel by a tube-side outlet nozzle provided on the outlet channel at an outlet temperature.

In one embodiment, the first fluid is a first fluid to be cooled, the second fluid is a second cooling fluid and the second temperature value is higher than the first temperature value. This implies that the first fluid is cooled in the shell-and-tube equipment, the first fluid inlet into the inlet channel is a first fluid to be cooled, the first fluid outlet from the outlet channel is the cooled first fluid. Distinctly, this implies that the above objects are achieved by a method of controlling the outlet temperature of a first fluid cooled in a shell-and-tube equipment at a target value by means of a bypass system. The method comprises:

inletting a first fluid to be cooled into an inlet channel by a tube-side inlet nozzle provided on the inlet channel, distributing the first fluid into a plurality of tube-bundle tubes having a first open end in fluid communication with the inlet channel and a second open end in fluid communication with an outlet channel, which second open end is connected to a tube-sheet, splitting the first fluid, depending on the position of a regulating valve, into a bypass flow flowing in a plurality of bypass bayonet tubes of the bypass system and a main flow flowing in an annular gap formed in between each tube-bundle tube and the corresponding bypass bayonet tube, the bypass system comprising a box provided with an opening or conduit, the regulating valve and a box tube-sheet, wherein each bayonet tube extends from the box tube-sheet to a point in between the first open end and the second open end of the tube-bundle tubes and is partially inserted into a corresponding tube-bundle tube, the plurality of bypass bayonet tubes being in fluid communication with the box through the box tube-sheet, the box being installed inside the outlet channel, inletting a second cooling fluid in a chamber around the tube-bundle tubes by a shell-side inlet nozzle provided on a shell sealingly enclosing the chamber, outletting the second cooling fluid from the chamber by a shell-side outlet nozzle provided on the shell after indirect heat exchange with the first fluid through the tube-bundle tubes, discharging the main flow from the annular gap of the tube-bundle tubes into the outlet chamber at a first temperature value, discharging the bypass flow from the bypass system into the outlet chamber at a second temperature value that is higher than the first temperature value, outletting the cooled first fluid from the outlet channel by a tube-side outlet nozzle provided on the outlet channel at an outlet temperature.

In detail, the equipment according to the present invention is typically a process gas cooler of shell-and-tube type for the indirect cooling of a process gas, which is provided with a bypass system for controlling the gas temperature at the outlet of the cooler. The process gas cooler is also provided with at least one tube-sheet which exchanging tubes are connected to. The hot process gas flows on tube-side and the cooling medium flows on shell-side. Hot process gas can be any gaseous medium coming from a chemical reactor, with a temperature above 400° C. and a pressure above 0.15 MPa(abs) at the inlet of the cooler. The cooling medium is preferably water at saturation conditions or in sub-cooled conditions. The hot process gas and the cooling medium are indirectly contacted according to a cross-flow, a co-current and/or a counter-current flow configuration. The hot process gas and the cooling medium may be indirectly contacted according to a cross-flow configuration or both co-current and counter-current flows configurations. The bypass system is entirely enclosed into the tube-side of the process gas cooler body and, more precisely, is almost fully installed in the outlet channel of the process gas cooler. In particular the box, including the box tube-sheet, the opening or conduit and the regulating valve, is fully installed in the outlet channel. The bypass system has the basic object to control the outlet temperature of the process gas.

The shell-and-tube equipment according to the present invention is substantially different from that of U.S. Pat. No. 4,294,312, since the equipment of U.S. Pat. No. 4,294,312:

- has the basic object to avoid a high heat loading at the inlet tube-sheet and at the inlet portion of tubes;
- has the insert tubes inserted into the tubes for the whole length of tubes and extending beyond both tube-sheets and both ends of the tubes;
- has a third intermediate tube-sheet, which the insert tubes are connected to, installed in the inlet channel and forming an intermediate chamber;
- has a reversing chamber at outlet of the tubes;
- has the flow in the insert tubes and the flow in the annular space that are in counter-current configuration.

The shell-and-tube equipment according to the present invention is also substantially different from that of US 2015/0004552, since US 2015/0004552:

- is aimed to reduce the overheating of the internal components of a heat exchanger;
- refers to a pure counter-current shell-and-tube heat exchanger;
- has the hot medium on the shell-side and the cooling medium on tube-side;
- the control valve is not enclosed into the exchanger body;
- the control valve is of 3-way type;
- the bypass plenum or box is not enclosed either into the exchanger body or into the main plenum;
- the bypass system is installed at the tube-side inlet of the heat exchanger;
- the recombination of the bypass and main flows occurs in the tubes.

Further characteristics of the invention are underlined by the dependent claims, which are an integral part of the present description.

BRIEF DESCRIPTION OF THE DRAWINGS

The characteristics and advantages of a shell-and-tube equipment with bypass according to the present invention will be clearer from the following exemplifying and non-limiting description, with reference to the enclosed schematic drawings, in which.

DETAILED DESCRIPTION OF THE PREFERRED EMBODIMENTS

Figure 3:
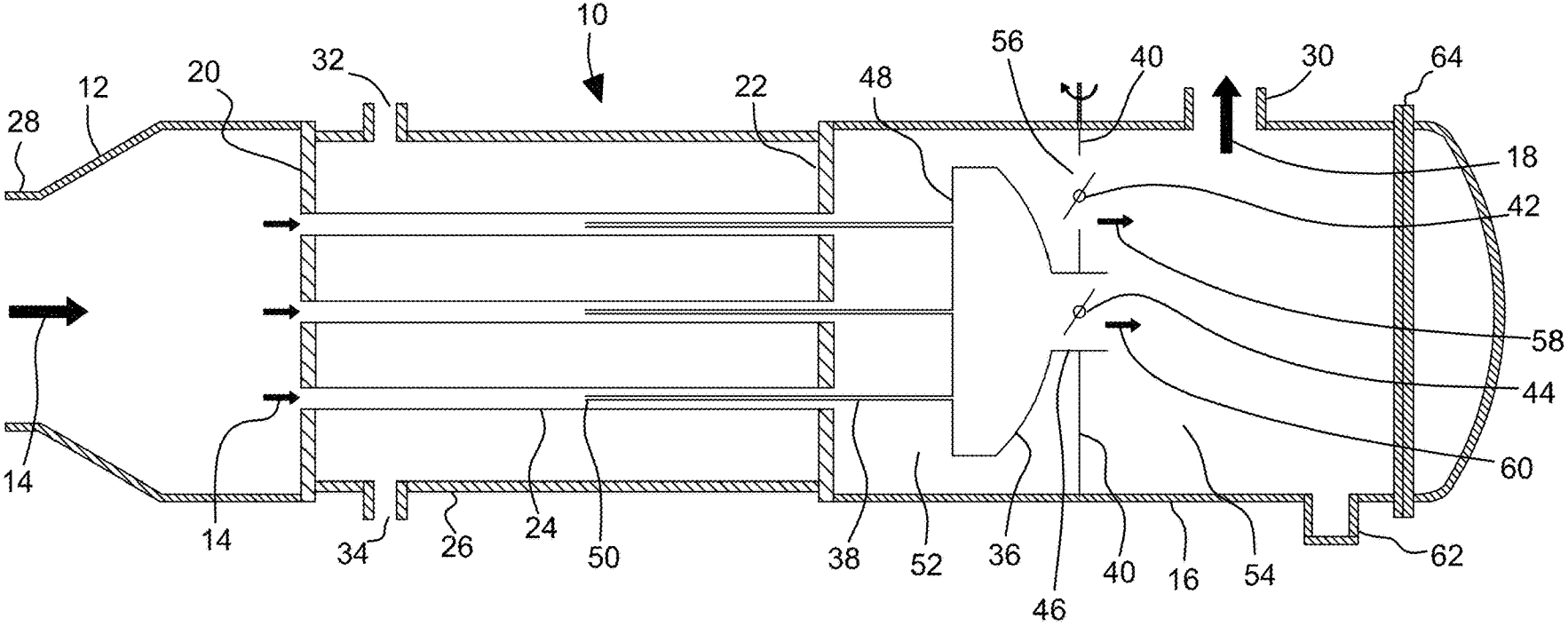
FIG. 3 schematically shows a first preferred embodiment of a shell-and-tube equipment with bypass according to the present invention.
Figure 4:
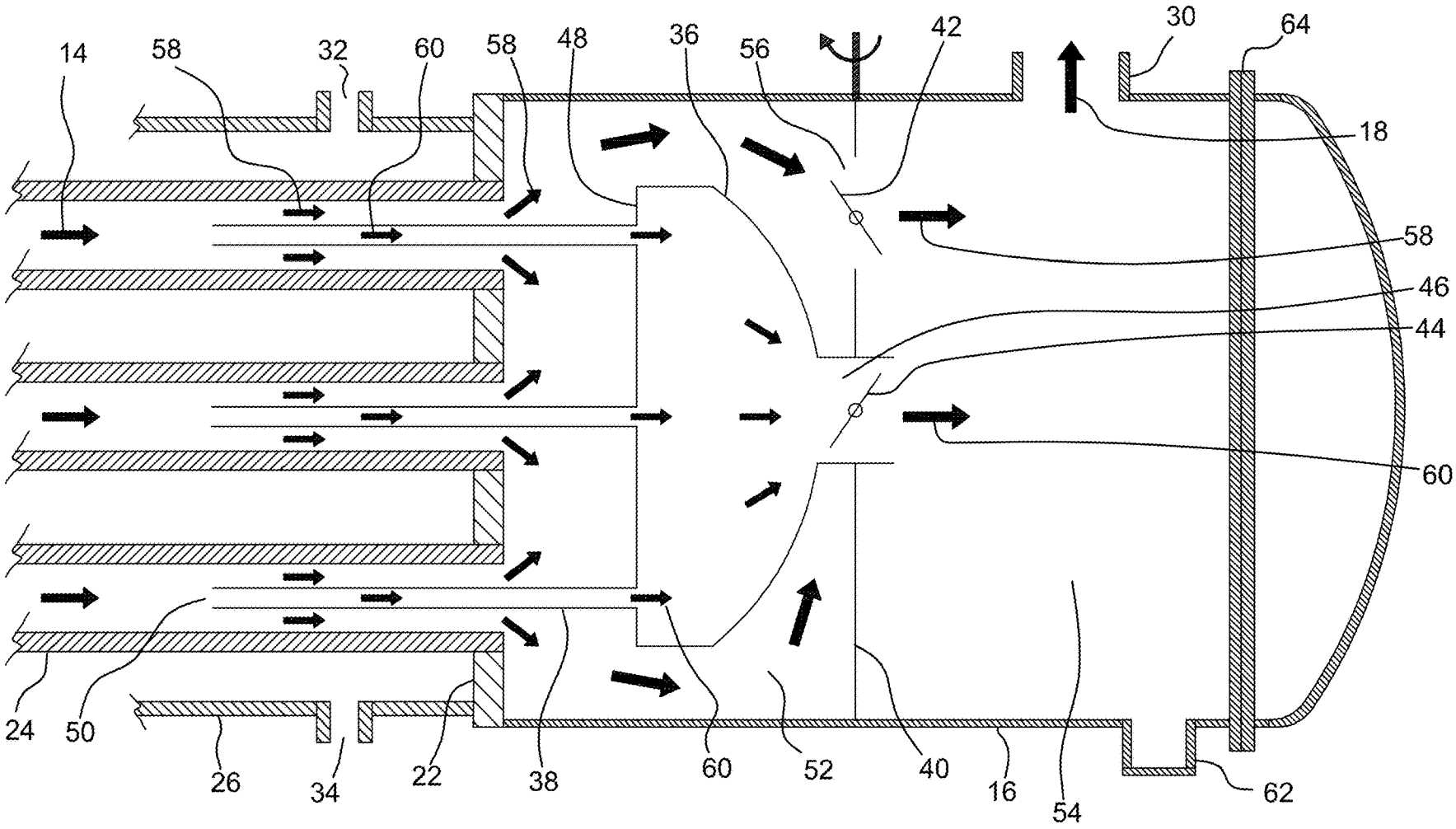
FIG. 4 is a partial view of the shell-and-tube equipment of FIG. 3, wherein the fluid flows are shown.

With reference to FIGS. 3 and 4, a preferred embodiment of the shell-and-tube equipment 10 with bypass according to the present invention is shown.

The shell-and-tube equipment 10, typically a process gas cooler, comprises at least an inlet channel 12, wherein a first fluid 14 to be cooled, typically hot process gas, enters into the shell-and-tube equipment 10, and at least an outlet channel 16, wherein the first cooled fluid 18 exits from the shell-and-tube equipment 10. The shell-and-tube equipment 10 also comprises an inlet tube-sheet 20, in fluid communication with the inlet channel 12 downstream of said inlet channel 12, and an outlet tube-sheet 22, in fluid communication with the outlet channel 16 upstream of said outlet channel 16. The outlet tube-sheet 22 may be denoted main tube-sheet.

The shell-and-tube equipment 10 further comprises a plurality of tubes 24 of a tube-bundle, connected at a first or inlet open end thereof to the inlet tube-sheet 20 and at a second or outlet open end thereof to the outlet tube-sheet 22. In other words, the first open end of each tube 24 is in fluid communication with the inlet channel 12, whereas the second open end of each tube 24 is in fluid communication with the outlet channel 16, so that the inlet channel 12 is in fluid communication with the outlet channel 16 through the tube-bundle tubes 24. A shell 26 sealingly encloses a chamber around the tube-bundle tubes 24. In the specific embodiment shown in the FIGS. 3 and 4, the shell 26 is sealingly joined between the inlet tube-sheet 20 and the outlet tube-sheet 22. In an alternative embodiment, the shell 26 could be directly connected to the inlet channel 12 and the outlet channel 16.

At least a tube-side inlet nozzle 28 is provided on the inlet channel 12 for inletting the first fluid 14 therein, whereas at least a tube-side outlet nozzle 30 is provided on the outlet channel 16 for outletting the first fluid 14 thereof. Similarly, at least a shell-side inlet nozzle 32 is provided on the shell 26 for inletting a second cooling fluid in the chamber enclosed by said shell 26, whereas at least a shell-side outlet nozzle 34 is provided on the shell 26 for outletting the second cooling fluid from the chamber enclosed by said shell 26. The second fluid is typically a cooling medium that indirectly exchanges heat with the first fluid 14 to be cooled.

According to a first, preferred embodiment, at least a box 36, a plurality of bypass bayonet tubes 38, a dividing wall 40, at least a first regulating valve 42 and at least a second regulating valve 44 are installed inside the outlet channel 16. The box 36 is provided with at least one opening or conduit 46, placed at a corresponding second regulating valve 44, and with a box tube-sheet 48. The bayonet tubes 38 are in fluid communication with the box 36 through the box tube-sheet 48.

Each bayonet tube 38 extends backwards from the box tube-sheet 48 to a point in between the inlet tube-sheet 20 and the outlet tube-sheet 22 and is partially inserted into a corresponding tube-bundle tube 24, ideally according to a concentric layout, so as an annular gap in between each tube-bundle tube 24 and the corresponding bayonet tube 38 is formed. In other words, the outside diameter of each bayonet tube 38 is always smaller than the inside diameter of the corresponding tube-bundle tube 24, so as to allow the bayonet insertion and to form the aforementioned annular gap. The bayonet tube ends 50 inserted inside the tube-bundle tubes 24 are open, so as to be in fluid communication with said tube-bundle tubes 24.

The dividing wall 40 splits the outlet channel 16 into a first chamber 52, that encloses a portion of the outlet channel 16 in fluid communication with the outlet tube-sheet 22, and a second chamber 54, that encloses another portion of the outlet channel 16 in fluid communication with the tube-side outlet nozzle 30. The dividing wall 40 is provided with at least one opening or conduit 56 which puts in communication the first chamber 52 with the second chamber 54. The first chamber 52 is in communication with the tube-bundle tubes 24 and collects a first amount 58 ("main flow") of the first fluid exiting from said tube-bundle tubes 24. The second chamber 54 is in communication with the first chamber 52 by the opening or conduit 56, with the box 36 by the opening or conduit 46 and with the tube-side outlet nozzle 30. Therefore, the second chamber 54 collects both a second amount 60 ("bypass flow") of the first fluid coming from the box 36 and the first amount 58 of the first fluid coming from the first chamber 52, and then delivers the combined amounts 18 of the first fluid to the tube-side outlet nozzle 30. The opening or conduit 46 is provided with the second regulating valve 44 that regulates the free cross area of said opening or conduit 46 available for the bypass flow 60 of the first fluid. The opening 56 is provided with the first regulating valve 42 that regulates the free cross area of said opening or conduit 56 available for the main flow 58 of the first fluid.

The first fluid 14 (hot process gas) enters into the inlet channel 12 by the tube-side inlet nozzle 28. The hot process gas 14 then distributes into the tube-bundle tubes 24, where it exchanges heat with the shell-side second fluid (cooling medium). The hot process gas and the cooling medium are indirectly contacted according to a cross-flow configuration, a co-current flow configuration and/or a counter-current flow configuration. When the process gas 14 reaches the bayonet tube ends 50, depending on the position of regulating valves 42 and 44, said process gas 14 can split into two flows, the main flow 58 flowing in the annular gap between tube-bundle tubes 24 and bayonet tubes 38, and the bypass flow 60 flowing in the bayonet tubes 38.

The main flow 58 is in direct contact with the tube-bundle tubes 24, that in turn are in direct contact with the cooling medium on the shell-side. On the contrary, the bypass flow 60 is not in direct contact with the tube-bundle tubes 24. As a result, the main flow 58 has a larger heat exchange than the bypass flow 60. The main flow 58 is discharged from the tube-bundle tubes 24, or more specifically from the annular gap, into the first chamber 52 of the outlet channel 16 at a first temperature value T1, whereas the bypass flow 60 is discharged from the bayonet tubes 38 into the box 36 at a second temperature value T2 that is higher than the first temperature value T1. In other words, after the tube-bundle tubes 24, the main flow 58 is colder than the bypass flow 60.

The main flow 58 moves from the first chamber 52 to the second chamber 54 across the first regulating valve 42. The bypass flow 60 moves from box 36 to the second chamber 54 across the second regulating valve 44. The main 58 and bypass 60 flows respectively discharged from valves 42 and 44 recombine in the second chamber 54, mix together and then the combined flow 18, which is at a third temperature value T3 in between T1 and T2, leaves the outlet channel 16 by the tube-side outlet nozzle 30.

The temperature of the outlet process gas 18 is measured downstream the tube-side outlet nozzle 30. If the outlet gas 18 temperature is not at the target value, the position of the regulating valves 42 and 44 is adjusted in order to modify the amount of the main 58 and bypass 60 flows. Accordingly, the overall heat exchange in the portion of tube-bundle tubes 24 housing the bayonet tubes 38 is modified and the temperature T3 of the outlet process gas 18 is adjusted to the target value. The valves 42 and 44 preferably regulate as per a logic scheme: when the first regulating valve 42 closes, the second regulating valve 44 opens, and vice versa.

According to a second embodiment of the shell-and-tube equipment 10, the first regulating valve 42 placed at the opening or conduit 56 of the dividing wall 40 may not be present. In this embodiment the temperature of the outlet process gas 18 is measured downstream the tube-side outlet nozzle 30 and, if said temperature is not at the target value, the position of the regulating valve 44 only is adjusted in order to modify the amount of the main 58 and bypass 60 flows. Accordingly, the overall heat exchange in the portion of tube-bundle tubes 24 housing the bayonet tubes 38 is modified and the temperature of the outlet process gas 18 is adjusted to the target value.

According to a third embodiment of the shell-and-tube equipment 10, both the dividing wall 40 and the respective opening or conduit 56, as well as the first regulating valve 42, are not present on said shell-and-tube equipment 10. In this embodiment the outlet channel 16 is no more split into two chambers and collects both the main flow 58 exiting from tube-bundle tubes 24 and the bypass flow 60 exiting from the box 36. The main 58 and bypass 60 flows recombine and mix in the outlet channel 16. The temperature T3 of the outlet process gas 18 is measured downstream the tube-side outlet nozzle 30 and, if said temperature is not at the target value, the position of the regulating valve 44 only is adjusted in order to modify the amount of the main 58 and bypass 60 flows. Accordingly, the overall heat exchange in the portion of tube-bundle tubes 24 housing the bayonet tubes 38 is modified and the temperature of the outlet process gas 18 is adjusted to the target value.

Regardless of the specific embodiment of the shell-and-tube equipment 10, the bayonet tubes 38 can be:

- of different shape and dimensions from each other, although with an outside diameter that is smaller than the inside diameter of the tube-bundle tubes 24;
- different among them;
- inserted only into a first set of tube-bundle tubes 24, whereas the remaining set of tube-bundle tubes 24 is without bayonet tubes 38.

The bypass system can be dismantled in several components and then these components can be removed from the shell-and-tube equipment 10 by at least a manhole 62 provided on the outlet channel 16. Alternatively, the bypass system can be removed in one single block or in several blocks by a removable main flange 64 provided on the outlet channel 16. The bypass system can be made of any construction material.

Figure 5:
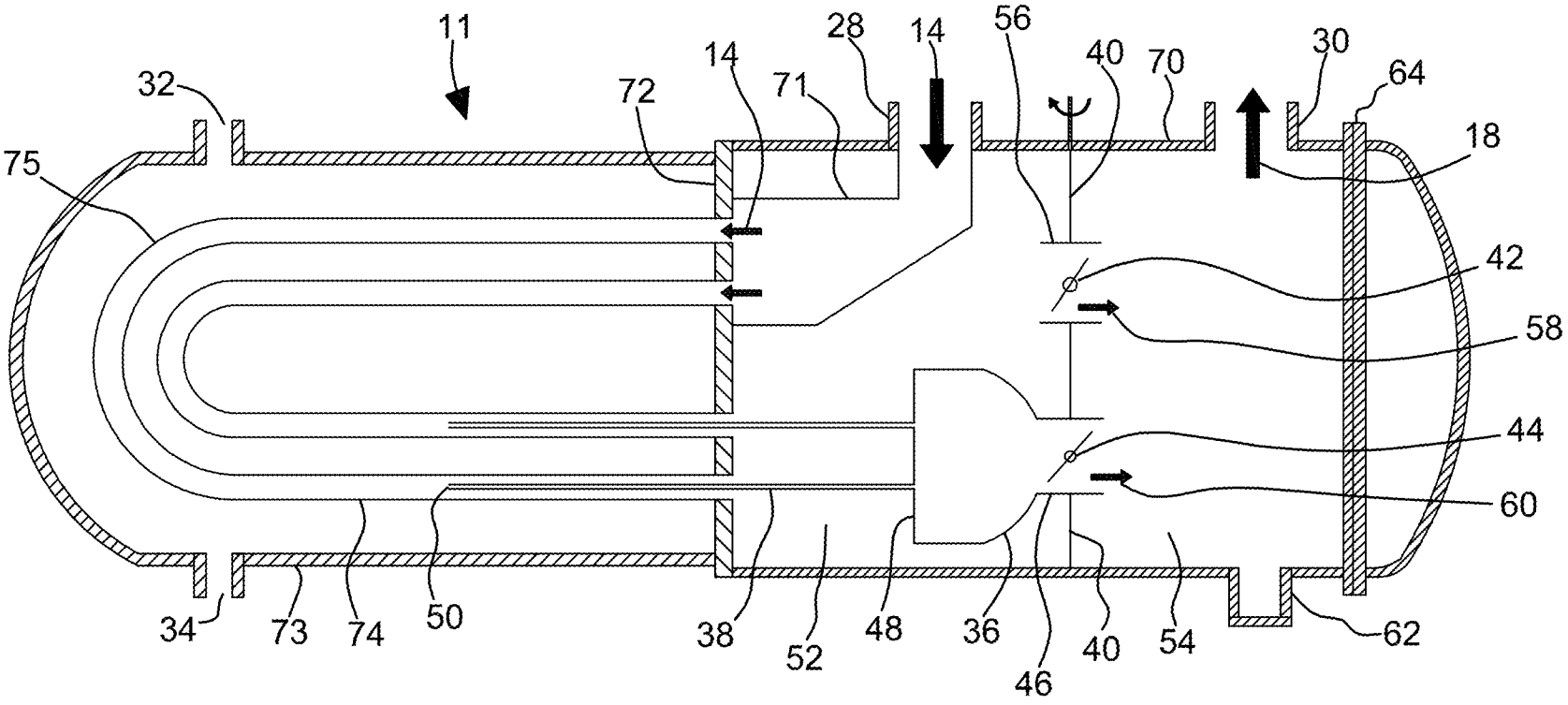
FIG. 5 schematically shows a second preferred embodiment of a shell-and-tube equipment with bypass according to the present invention.
Figure 6:
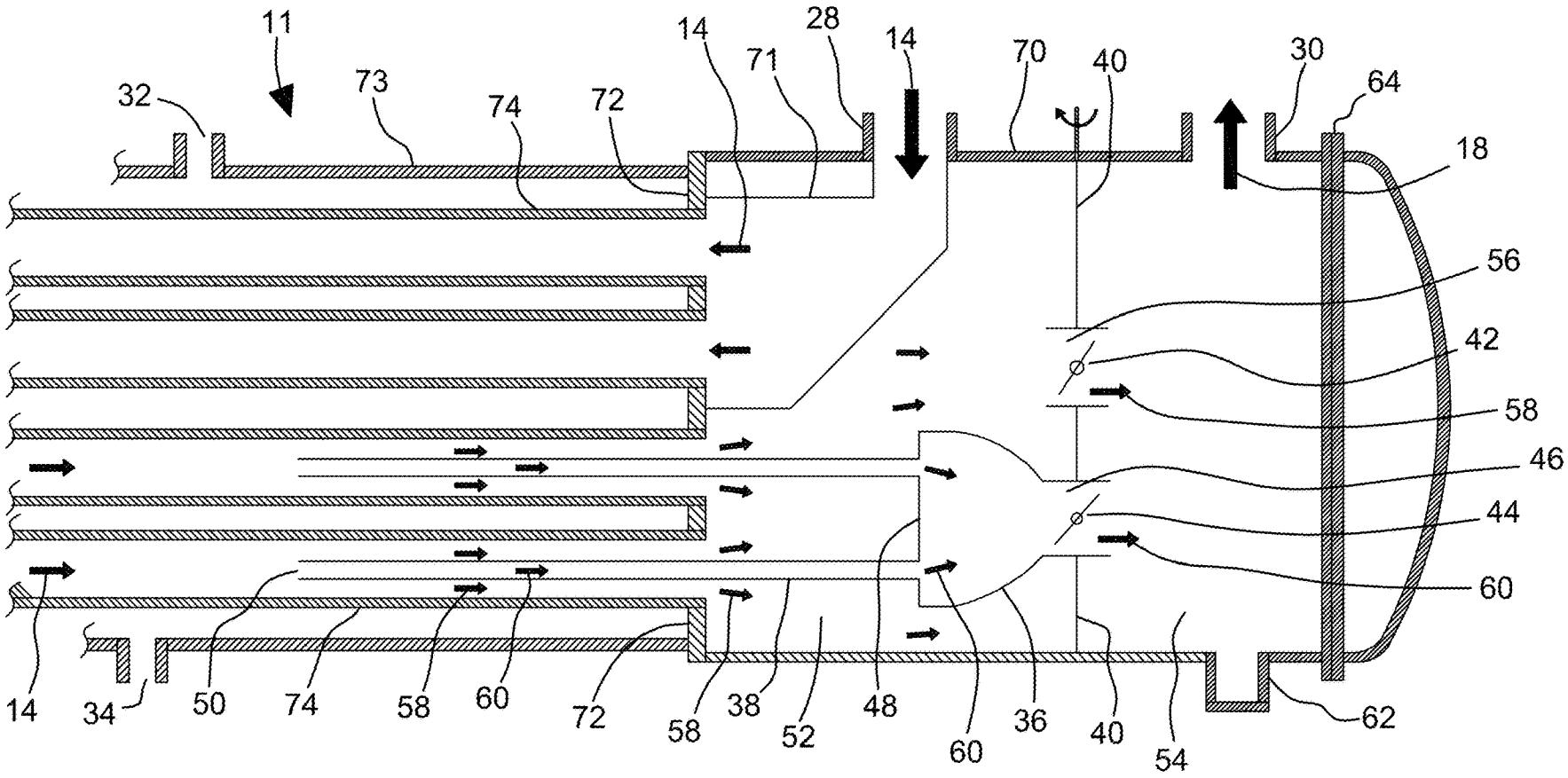
FIG. 6 is a partial view of the shell-and-tube equipment of FIG. 5, wherein the fluid flows are shown.

With reference to FIGS. 5 and 6, a second preferred embodiment of the shell-and-tube equipment 11 with bypass according to the present invention is shown. The shell-and-tube equipment 11, typically a process gas cooler, comprises at least an inlet channel 71, wherein a first fluid 14 to be cooled, typically hot process gas, enters into the shell-and-tube equipment 11, and at least an outlet channel 70, wherein the first cooled fluid 18 exits from the shell-and-tube equipment 11. The outlet channel 70 and the inlet channel 71 are arranged in order that the outlet channel 70 encloses the inlet channel 71, and in order that the inlet channel 71 and the outlet channel 70 are not in direct communication each other. The shell-and-tube equipment 11 also comprises a single tube-sheet 72, in fluid communication with the inlet channel 71 and the outlet channel 70. The single tube sheet 72 may be denoted main tube-sheet.

The shell-and-tube equipment 11 further comprises a plurality of U-shaped tubes 74 of a tube-bundle, connected at a first open end thereof, or at the inlet end, to the tube-sheet 72 and in fluid communication with the inlet channel 71, and at a second open end thereof, or at the outlet end, to the tube-sheet 72 and in fluid communication with the outlet channel 70. In other words, the first open end of each tube 74 is in fluid communication with the inlet channel 71, whereas the second open end of each tube 74 is in fluid communication with the outlet channel 70, so that the inlet channel 71 is in fluid communication with the outlet channel 70 through the tube-bundle tubes 74. A shell 73 sealingly encloses a chamber around the tube-bundle tubes 74. In the specific embodiment shown in the FIGS. 5 and 6, the shell 73 is sealingly joined to the tube-sheet 72. In an alternative embodiment, the shell 73 could be directly connected to the outlet channel 70.

At least a tube-side inlet nozzle 28 is provided on the outlet channel 70 for inletting the first fluid 14 therein the inlet channel 71, whereas at least a tube-side outlet nozzle 30 is provided on the outlet channel 70 for outletting the first fluid 14 thereof. Similarly, at least a shell-side inlet nozzle 32 is provided on the shell 73 for inletting a second cooling fluid in the chamber enclosed by said shell 73, whereas at least a shell-side outlet nozzle 34 is provided on the shell 73 for outletting the second cooling fluid from the chamber enclosed by said shell 73. The second fluid is typically a cooling medium that indirectly exchanges heat with the first fluid 14 to be cooled.

According to this embodiment at least a box 36, a plurality of bypass bayonet tubes 38, a dividing wall 40, at least a first regulating valve 42 and at least a second regulating valve 44 are installed inside the outlet channel 70. The box 36 is provided with at least one opening or conduit 46, placed at a corresponding second regulating valve 44, and with a box tube-sheet 48. The bayonet tubes 38 are in fluid communication with the box 36 through the box tube-sheet 48.

Each bayonet tube 38 extends backwards from the box tube-sheet 48 to a point in between the first end and the second end of the tube-bundle tubes 74, and is partially inserted into a corresponding tube-bundle tube 74, ideally according to a concentric layout, so as an annular gap in between each tube-bundle tube 74 and the corresponding bayonet tube 38 is formed. In other words, the outside diameter of each bayonet tube 38 is always smaller than the inside diameter of the corresponding tube-bundle tube 74, so as to allow the bayonet insertion and to form the aforementioned annular gap. The bayonet tube ends 50 inserted inside the tube-bundle tubes 74 are open, so as to be in fluid communication with said tube-bundle tubes 74.

The dividing wall 40 splits the outlet channel 70 into a first chamber 52, that encloses a portion of the outlet channel 70 in fluid communication with the second end of tube-bundle tubes 74, and a second chamber 54, that encloses another portion of the outlet channel 70 in fluid communication with the tube-side outlet nozzle 30. The dividing wall 40 is provided with at least one opening or conduit 56 which puts in communication the first chamber 52 with the second chamber 54. The first chamber 52 is in communication with the second end of tube-bundle tubes 74 and collects a first amount 58 ("main flow") of the first fluid exiting from said tube-bundle tubes 74. The second chamber 54 is in communication with the first chamber 52 by the opening or conduit 56, with the box 36 by the opening or conduit 46 and with the tube-side outlet nozzle 30. Therefore, the second chamber 54 collects both a second amount 60 ("bypass flow") of the first fluid coming from the box 36 and the first amount 58 of the first fluid coming from the first chamber 52, and then delivers the combined amounts 18 of the first fluid to the tube-side outlet nozzle 30. The opening or conduit 46 is provided with the second regulating valve 44 that regulates the free cross area of said opening or conduit 46 available for the bypass flow 60 of the first fluid. The opening or conduit 56 is provided with the first regulating valve 42 that regulates the free cross area of said opening 56 available for the main flow 58 of the first fluid.

The first fluid 14 (hot process gas) enters into the inlet channel 71, which is enclosed into the outlet channel 70, by the tube-side inlet nozzle 28. The hot process gas 14 then distributes into the tube-bundle tubes 74, where it exchanges heat with the shell-side second fluid (cooling medium). The hot process gas and the cooling medium are indirectly contacted according to cross-flow, co-current and/or counter-current flows configurations. When the process gas 14 reaches the bayonet tube ends 50, depending on the position of regulating valves 42 and 44, said process gas 14 can split into two flows, the main flow 58 flowing in the annular gap between tube-bundle tubes 74 and bayonet tubes 38, and the bypass flow 60 flowing in the bayonet tubes 38.

The main flow 58 is in direct contact with the tube-bundle tubes 74, that in turn are in direct contact with the cooling medium on the shell-side. On the contrary, the bypass flow 60 is not in direct contact with the tube-bundle tubes 74. As a result, the main flow 58 has a larger heat exchange than the bypass flow 60. The main flow 58 is discharged from the tube-bundle tubes 74, or more specifically from the annular gap, into the first chamber 52 of the outlet channel 70 at a first temperature value T1, whereas the bypass flow 60 is discharged from the bayonet tubes 38 into the box 36 at a second temperature value T2 that is higher than the first temperature value T1. In other words, after the tube-bundle tubes 74, the main flow 58 is colder than the bypass flow 60.

The main flow 58 moves from the first chamber 52 to the second chamber 54 across the first regulating valve 42. The bypass flow 60 moves from box 36 to the second chamber 54 across the second regulating valve 44. The main 58 and bypass 60 flows respectively discharged from valves 42 and 44 recombine in the second chamber 54, mix together and then the combined flow 18, which is at a third temperature value T3 in between T1 and T2, leaves the outlet channel 70 by the tube-side outlet nozzle 30.

The temperature of the outlet process gas 18 is measured downstream the tube-side outlet nozzle 30. If the outlet gas 18 temperature is not at the target value, the position of the regulating valves 42 and 44 is adjusted in order to modify the amount of the main 58 and bypass 60 flows. Accordingly, the overall heat exchange in the portion of tube-bundle tubes 74 housing the bayonet tubes 38 is modified and the temperature T3 of the outlet process gas 18 is adjusted to the target value. The valves 42 and 44 preferably regulate as per a logic scheme: when the first regulating valve 42 closes, the second regulating valve 44 opens, and vice versa.

According to another embodiment of the shell-and-tube equipment 11, the first regulating valve 42 placed at the opening or conduit 56 of the dividing wall 40 may not be present. In this embodiment the temperature of the outlet process gas 18 is measured downstream the tube-side outlet nozzle 30 and, if said temperature is not at the target value, the position of the regulating valve 44 only is adjusted in order to modify the amount of the main 58 and bypass 60 flows. Accordingly, the overall heat exchange in the portion of tube-bundle tubes 74 housing the bayonet tubes 38 is modified and the temperature of the outlet process gas 18 is adjusted to the target value.

According to another embodiment of the shell-and-tube equipment 11, both the dividing wall 40 and the respective opening or conduit 56, as well as the first regulating valve 42, are not present on said shell-and-tube equipment 11. In this embodiment the outlet channel 16 is no more split into two chambers and collects both the main flow 58 exiting from tube-bundle tubes 74 and the bypass flow 60 exiting from the box 36. The main 58 and bypass 60 flows recombine and mix in the outlet channel 70. The temperature T3 of the outlet process gas 18 is measured downstream the tube-side outlet nozzle 30 and, if said temperature is not at the target value, the position of the regulating valve 44 only is adjusted in order to modify the amount of the main 58 and bypass 60 flows. Accordingly, the overall heat exchange in the portion of tube-bundle tubes 74 housing the bayonet tubes 38 is modified and the temperature of the outlet process gas 18 is adjusted to the target value.

Regardless of the specific embodiment of the shell-and-tube equipment 11, the bayonet tubes 38 can be:

- of different shape and dimensions from each other, although with an outside diameter that is smaller than the inside diameter of the tube-bundle tubes 74;
- different among them;
- inserted only into a first set of tube-bundle tubes 74, whereas the remaining set of tube-bundle tubes 74 is without bayonet tubes 38.

The bypass system can be dismantled in several components and then these components can be removed from the shell-and-tube equipment 11 by at least a manhole 62 provided on the outlet channel 70. Alternatively, the bypass system can be removed in one single block or in several blocks by a removable main flange 64 provided on the outlet channel 70. The bypass system can be made of any construction material.

Figure 7:
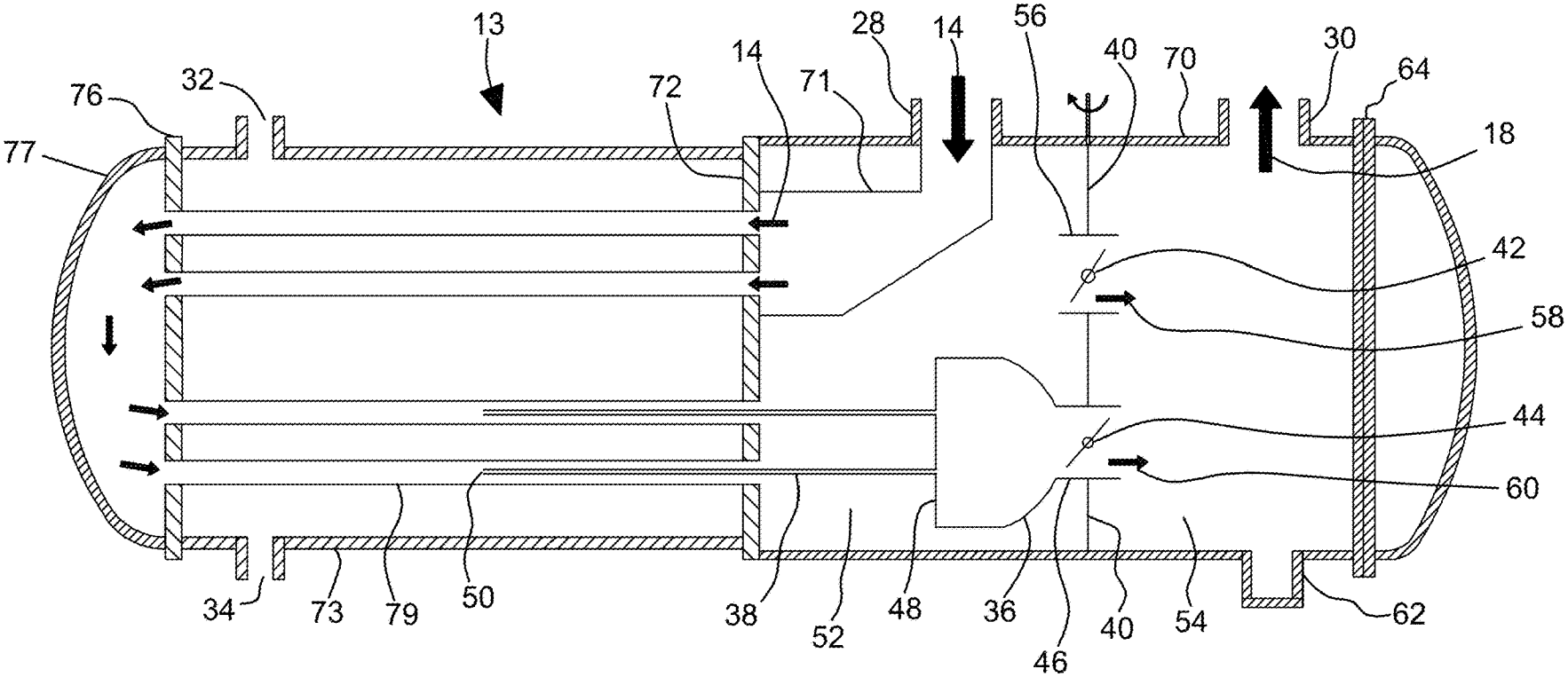
FIG. 7 schematically shows a third preferred embodiment of a shell-and-tube equipment with bypass according to the present invention.

With reference to FIG. 7, a third preferred embodiment of the shell-and-tube equipment 13 with bypass according to the present invention is shown. The shell-and-tube equipment 13, typically a process gas cooler, is similar to the shell-and-tube equipment 11 of FIG. 5 except for the tube-bundle tubes 79 that are not provided with the U-bends 75 shown in FIG. 5. The shell-and-tube equipment 13 comprises tube-bundle tubes 79 provided, in between their first open end and their second open end connected to the tube-sheet 72, with an intermediate connection to an intermediate tube-sheet 76. The shell-and-tube equipment 13 also comprises an intermediate channel 77, connected to the intermediate tube-sheet 76 or the shell 73, in fluid communication with the tube-bundle tubes 79. Each bayonet tube 38 extends backwards from the box tube-sheet 48 to a point in between the intermediate tube-sheet 76 and the tube-sheet 72 and is partially inserted into a corresponding tube-bundle tube 79. The bypass system described for FIG. 6 is valid also for the shell-and-tube equipment 13 of FIG. 7. This tube-sheet 72 may be denoted first tube-sheet or main tube-sheet.

As per above description of FIGS. 3 to 7, it is clear that the bypass system disclosed herein is conceptually identical for shell-and-tube equipment with both straight tubes (two tube-sheets) and U-shaped tubes (one tube-sheet). For all the embodiments described above, in order to reduce or eliminate the heat transfer across the bayonet tubes 38 between bypass 60 and main 58 flows, the bayonet tubes 38 can be designed with a thermal barrier, which may be either an insulating layer installed on one side or both sides of the bayonet tubes 38, or bayonet tubes 38 constituted of a double wall with an interspace filled by stagnant gas or insulating material. The bypass tubes 38 are partially installed inside the outlet channel 16; 70 and partially inserted into the tube-bundle tubes 24; 74; 79. The regulating valve 44 of the box 36 is a 2-way valve. Also the regulating valve 42 of the wall 40 is a 2-way valve.

The first fluid 14 may be a hot process gas put in indirect contact with the second cooling fluid according to a cross-flow, a co-current and/or a counter-current flow configuration. The first fluid 14 of the method may be a hot process gas put in indirect contact with the second cooling fluid according to a cross-flow configuration or according to both co-current and counter-current flows configurations. The first fluid 14 may be a hot process gas put in indirect contact with the second cooling fluid according to a cross-flow configuration. The first fluid 14 may be a hot process gas put in indirect contact with the second cooling fluid according to both co-current and counter-current flows configurations.

The outlet channel 16; 70 may be provided with at least a manhole 62 to perform the extraction of the bypass system components once dismantled.

The outlet channel 16; 70 may be provided with a removable main flange 64 to perform the extraction of the bypass system in one single block or in several blocks.

According to one aspect, the present invention relates to a method of controlling the outlet temperature of a first fluid cooled in a shell-and-tube equipment 10; 11; 13 at a target value by means of a bypass system. The method comprises the steps:

- inletting a first fluid 14 to be cooled into an inlet channel 12; 71 by a tube-side inlet nozzle 28 provided on the inlet channel 12; 71,
- distributing the first fluid 14 into a plurality of tube-bundle tubes 24; 74; 79 having a first open end in fluid communication with the inlet channel 12; 71 and a second open end in fluid communication with an outlet channel 16; 70, which second open end is connected to a tube-sheet 22; 72,
- splitting the first fluid 14, depending on the position of a regulating valve 44, into a bypass flow 60 flowing in a plurality of bypass bayonet tubes 38 of the bypass system and a main flow 58 flowing in an annular gap formed in between each tube-bundle tube 24; 74; 79 and the corresponding bypass bayonet tube 38, the bypass system comprising a box 36 provided with an opening or conduit 46, the regulating valve 44 and a box tube-sheet 48, wherein each bayonet tube 38 extends from the box tube-sheet 48 to a point in between the first open end and the second open end of the tube-bundle tubes 24; 74; 79 and is partially inserted into a corresponding tube-bundle tube 24; 74; 79, the plurality of bypass bayonet tubes 38 being in fluid communication with the box 36 through the box tube-sheet 48, the box 36 being installed inside the outlet channel 16; 70, inletting a second cooling fluid in a chamber around the tube-bundle tubes 24; 74; 79 by a shell-side inlet nozzle 32 provided on a shell 26; 73 sealingly enclosing the chamber, outletting the second cooling fluid from the chamber by a shell-side outlet nozzle 34 provided on the shell 26; 73 after indirect heat exchange with the first fluid 14 through the tube-bundle tubes 24; 74; 79, discharging the main flow 58 from the annular gap of the tube-bundle tubes 24; 74; 79 into the outlet chamber 16; 70 at a first temperature value T1, discharging the bypass flow 60 from the bypass system into the outlet chamber 16; 70 at a second temperature value T2 that is higher than the first temperature value T1, outletting the cooled first fluid 14 from the outlet channel 16; 70 by a tube-side outlet nozzle 30 provided on the outlet channel 16; 70 at an outlet temperature T3.

The method may further comprise the step:

recombining the main flow 58 and the bypass flow 60 into a combined flow 18 of the (cooled) first fluid, which is at the outlet temperature T3, which step is performed after the steps of discharging the main flow and the bypass flow and before the step of outletting the (cooled) first fluid. The main flow 58 and the bypass flow 60 recombine and mix in the outlet channel 16; 70. The outlet temperature is the result of the recombining of the main flow and the bypass flow. When recombining the main flow and the bypass flow, the main flow and the bypass flow are mixed.

In the method, the amount of the main flow 58 and the amount of the bypass flow 60 into which the first fluid 14 is split may be regulated by the regulating valve 44. This may be achieved by regulating the amount of the main flow 58 and the amount of the bypass flow 60 into which the first fluid 14 is split by the regulating valve 44.

The method may further comprise the step:

adjusting the position of the regulating valve 44 in order to modify the amount of the main flow 58 and the bypass flow 60 if the outlet temperature T3 of the (cooled) first fluid is not at the target value, which is performed after the step of outletting the cooled first fluid. In case of a process gas cooler, if the outlet temperature T3 is higher than the target value, the amount of the main flow 58 is increased and the amount of the bypass flow 60 is decreased. Correspondingly, if the outlet temperature T3 is lower than the target value, the amount of the main flow 58 is decreased and the amount of the bypass flow 60 is increased.

The step of discharging the main flow 58 from the annular gap of the tube-bundle tubes 24; 74; 79 into the outlet chamber 16; 70 at a first temperature value T1 may be performed by discharging the main flow 58 into a first chamber 52 that encloses a first portion of the outlet channel 16; 70 in fluid communication with the second end of the tube-bundle tubes 24; 74; 79. The outlet channel 16; 70 may be split by a dividing wall 40 of the bypass system into the first chamber 52 that encloses a first portion of the outlet channel 16; 70 in fluid communication with the second end of the tube-bundle tubes 24; 74; 79 and a second chamber 54 that encloses a second portion of the outlet channel 16; 70 in fluid communication with the tube-side outlet nozzle 30.

The step of discharging the main flow 58 may comprise:

collecting the main flow 58 in the first chamber 52.

The step of discharging the main flow 58 may further comprise:

collecting both the main flow 58 and the bypass flow 60 in the second chamber 54.

The dividing wall 40 may be provided with an opening or conduit 56 which puts the first chamber 52 in communication with the second chamber 54. The second chamber 54 may be in communication with the first chamber 52 by the opening or conduit 56, with the box 36 and with the tube-side outlet nozzle 30.

The step of discharging the main flow 58 may be performed by discharging the main flow 58 into the second chamber 54 of the outlet chamber 16; 70 through the opening or conduit 56. The main flow 58 may be discharged from the first chamber 52 into the second chamber 54.

The step of discharging the bypass flow 60 may be performed by discharging the bypass flow 60 into the second chamber 54 of the outlet chamber 16; 70. The bypass flow 60 may be discharged into the outlet chamber 16; 70 through the opening or conduit 46. The bypass flow 60 may be discharged from the box 36 into the outlet chamber 16; 70. The bypass flow 60 may be discharged from the box 36 into the second chamber 54.

The step of outletting the cooled first fluid may comprise delivering the combined flow 18 to the tube-side outlet nozzle 30.

The splitting step may comprise:

regulating the free cross area of an opening or conduit 46 available for the bypass flow 60 by means of the regulating valve 44 provided in the opening or conduit 46 by which opening or conduit 46 the second chamber 54 is in communication with the box 36.

In case the regulating valve 42 of the wall 40 is provided, the splitting step may comprise:

regulating the free cross area of the opening or conduit 56 available for the main flow 58 by means of a regulating valve 42 provided in the opening or conduit 56 by which opening or conduit 56 the first chamber 52 is in communication with the second chamber 54.

In case the regulating valve 42 of the wall 40 is provided, the method may comprise the step:

adjusting the position of the regulating valve 44 of the box 36 and the regulating valve 42 of the wall 40 in order to modify the amount of the main flow 58 and the bypass flow 60 if the outlet temperature T3 of the cooled first fluid is not at the target value, which is performed after the step of outletting the cooled first fluid.

The first fluid 14 of the method may be a hot process gas put in indirect contact with the second cooling fluid according to a cross-flow, a co-current and/or a counter-current flow configuration. The first fluid 14 may be a hot process gas put in indirect contact with the second cooling fluid according to a cross-flow configuration. Alternatively, the first fluid 14 may be a hot process gas put in indirect contact with the second cooling fluid according to both co-current and counter-current flows configurations.

It is thus seen that the shell-and-tube equipment with bypass as well as the method of controlling the outlet temperature from a shell-and-tube equipment with bypass according to the present invention achieves the previously outlined objects.

It should be stressed that the box 36 is installed inside the outlet channel 16; 70. The box is provided with the regulating valve 44 and the box tube-sheet 48. Thereby, the regulating valve 44 is installed inside the outlet channel 16; 70. Also the box tube-sheet 48 is installed inside the outlet channel 16; 70. Further, the regulating valve 42 as well as the wall 40 is installed inside the outlet channel 16; 70.

Figure 1:
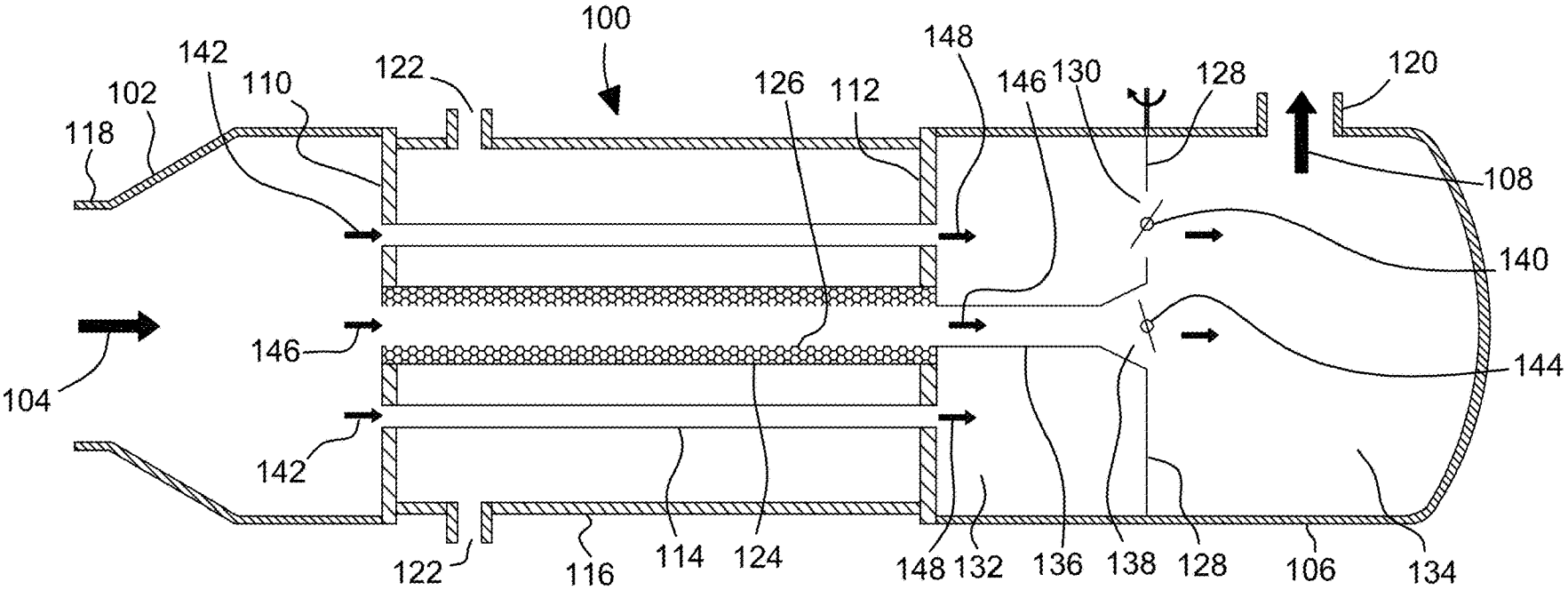
Fig. 1 (PRIOR ART)
FIGS. 1 and 2 schematically show respective shell-and-tube equipment with bypass according to the prior art.
Figure 2:
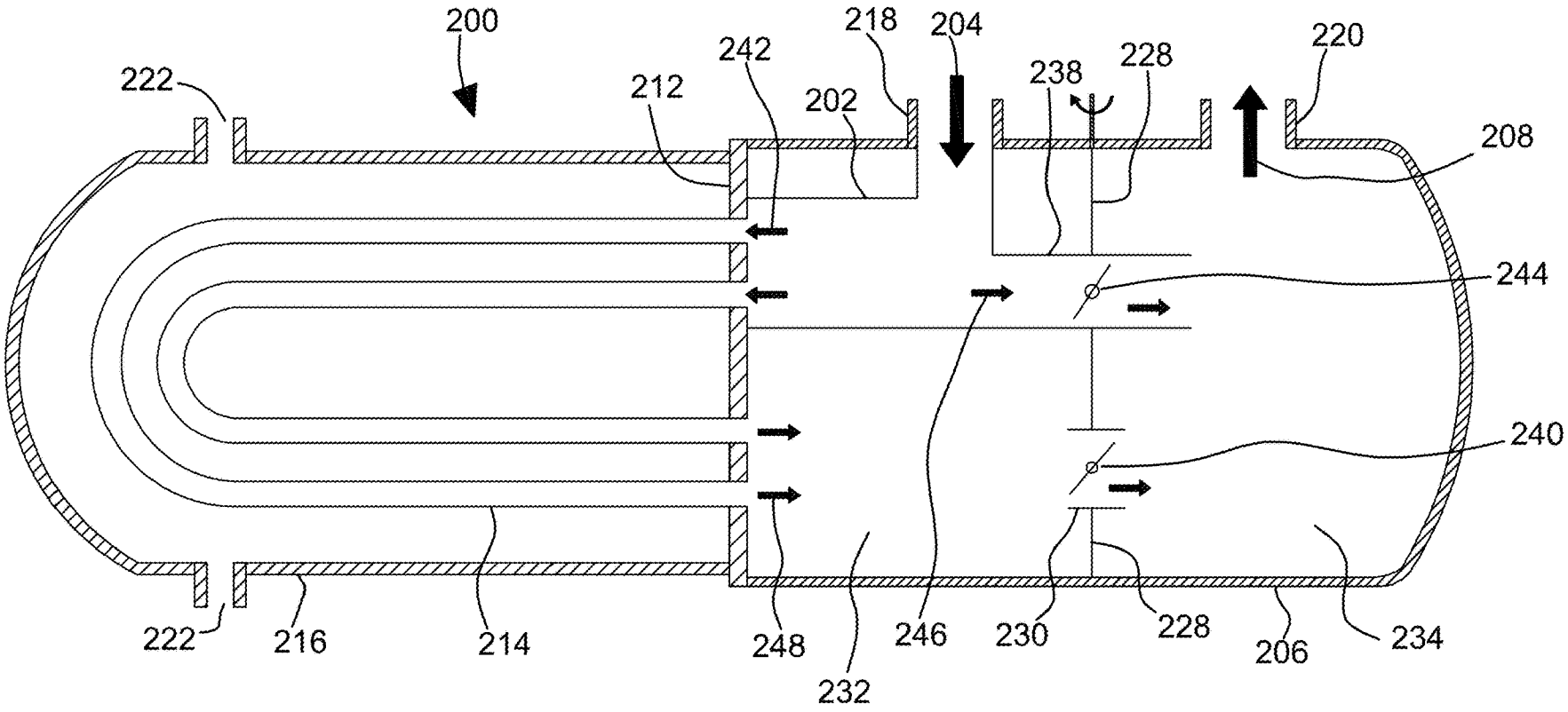
Fig. 2 (PRIOR ART)

Actually, the shell-and-tube equipment has the following major advantages:

the shell-and-tube equipment has no bypass tubes installed in the shell, outside the tube-bundle tubes, and therefore the resulting shell internal diameter can be reduced with respect to similar prior art shell-and-tube equipment (FIG. 1);

the bypass flow is pre-cooled in the first portion of the tube-bundle tubes, i.e. where the bayonet tubes are not present. Therefore, the whole bypass system works in colder conditions with respect to similar prior art shell-and-tube equipment (FIGS. 1 and 2), and corrosion and wear are greatly reduced;

the bypass components are no more pressure parts, but they are classified as internals from mechanical calculations standpoint;

the bypass system can be removed outside the shell-and-tube equipment for a full inspection and maintenance.

Since the box 36, the box tube-sheet 48 and the opening or conduit 46 and the regulating valve 44 of the bypass system, as well as the regulating valve 42, the opening or conduit 56 and the wall 40 thereof, are installed inside the outlet channel 16; 70, these parts can be classified as internal components and not pressure parts. These parts are subjected to the same pressure on the inside and the outside and thereby these parts do not have to be designed to withstand an external or internal pressure. The design of these parts is therefore simplified with e.g. smaller thickness and the demand on the construction and maintenance of these parts is reduced. This reduces costs. Further, since these parts are installed in the outlet channel, they will be cooled by the cooled main flow such that they work at a lower temperature, which reduces the risk of overheating and corrosion. This extends the design life and reduces costs. Since these parts are installed inside the outlet channel, the hot bypass stream is confined within the shell-and-tube equipment and mixed with the cold main flow before leaving the shell-and-tube equipment. Thereby, reliability and safety are assured thanks to moderate operating temperature of pressure parts.

The shell-and-tube equipment with bypass as well as the method of the present invention thus conceived is susceptible in any case of numerous modifications and variants, all falling within the same inventive concept; in addition, all the details can be substituted by technically equivalent elements. In practice, the materials used, as well as the shapes and size, can be of any type according to the technical requirements.

The scope of protection of the invention is therefore defined by the enclosed claims.

The invention claimed is:

1. Shell-and-tube equipment comprising:

at least an inlet channel, provided with at least a tube-side inlet nozzle for inletting a first fluid;

at least an outlet channel, provided with at least a tube-side outlet nozzle for outletting the first fluid;

a plurality of tube-bundle tubes having a first open end in fluid communication with the inlet channel and a second open end in fluid communication with the outlet channel;

at least a tube-sheet connected to the second open ends of said plurality of tubes;

a shell sealingly enclosing a chamber around the tube-bundle tubes, wherein said shell is provided with at least a shell-side inlet nozzle, for inletting a second fluid in said chamber, and with at least a shell-side outlet nozzle, for outletting said second fluid from said chamber after indirect heat exchange with said first fluid through said tube-bundle tubes; and a bypass system for controlling the outlet temperature (T3) of the first fluid at a target value, wherein the bypass system comprises:

at least a box installed inside the outlet channel, said box being provided with at least an opening or conduit, a regulating valve and a box tube-sheet, a plurality of bypass bayonet tubes in fluid communication with the box through the box tube-sheet, wherein each bayonet tube extends from the box tube-sheet to a point in between the first open end and the second open end of the tube-bundle tubes and is partially inserted into a corresponding tube-bundle tube, so as an annular gap in between each tube-bundle tube and the corresponding bayonet tube is formed, whereby the first fluid flow, depending on the position of said regulating valve, is split into a main flow flowing in said annular gap, and a bypass flow, flowing in said bayonet tubes, and said main flow is discharged from said tube-bundle tubes at a first temperature value (T1), whereas said bypass flow is discharged from said bypass system at a second temperature value (T2) that is different from the first temperature value (T1).

2. Shell-and-tube equipment according to claim 1, wherein the first fluid is a first fluid to be cooled, the second fluid is a second cooling fluid and the second temperature value is higher than the first temperature value.

3. Shell-and-tube equipment according to claim 1, wherein the bypass system comprises a dividing wall that splits the outlet channel into a first chamber, that encloses a first portion of said outlet channel in fluid communication with the second end of the tube-bundle tubes, and a second chamber, that encloses a second portion of said outlet channel in fluid communication with the tube-side outlet nozzle.

4. Shell-and-tube equipment according to claim 3, wherein the dividing wall is provided with at least one opening or conduit which puts in communication the first chamber with the second chamber wherein the first chamber is in communication with the tube-bundle tubes and collects said main flow, whereas the second chamber is in communication with the first chamber by said at least one opening or conduit, with said box and with the tube-side outlet nozzle, whereby said second chamber collects both said main flow and said bypass flow for delivering the combined flow to said tube-side outlet nozzle.

5. Shell-and-tube equipment according to claim 4, wherein the second chamber is in communication with said box by an opening or conduit, said opening or conduit of the box being provided with said regulating valve of the box that regulates the free cross area of said opening or conduit of the box available for said bypass flow.

6. Shell-and-tube equipment according to claim 4, wherein the opening or conduit of the dividing wall is provided with a regulating valve that regulates the free cross area of said opening or conduit of the dividing wall available for said main flow.

7. Shell-and-tube equipment according to anyone of claim 1, wherein it comprises an inlet tube-sheet, in fluid communication with the inlet channel downstream of said inlet channel, and a second outlet tube-sheet, in fluid communication with the outlet channel upstream of said outlet channel, wherein each tube-bundle tube is connected, at the first open end thereof, to the inlet tube-sheet and, at the second open end thereof, to the outlet tube-sheet, said tube-bundle tubes putting in fluid communication the inlet channel with the outlet channel.

8. Shell-and-tube equipment according to anyone of claim 1, wherein it comprises a single tube-sheet in fluid communication with the inlet channel and with the outlet channel, wherein the outlet channel encloses the inlet channel with no direct communication between said outlet channel and said inlet channel, and wherein each tube-bundle tube, at the first open end thereof, is connected to the single tube-sheet and is in fluid communication with the inlet channel and, at the second open end thereof, is connected to said single tube-sheet and is in fluid communication with the outlet channel, putting in fluid communication the inlet channel with the outlet channel.

9. Shell-and-tube equipment according to claim 1, wherein the tube-bundle tubes are provided, in between the first open end thereof connected to a first tube-sheet and a second open end thereof connected to the first tube-sheet, with an intermediate connection to an intermediate tube-sheet, the shell-and-tube equipment preferably comprising an intermediate channel, connected to the intermediate tube-sheet or the shell and in fluid communication with the tube-bundle tubes, wherein each bayonet tube preferably extends from the box tube-sheet to a point in between said intermediate tube-sheet and said first tube-sheet and is partially inserted into a corresponding tube-bundle tube.

10. Shell-and-tube equipment according to claim 1, wherein the bayonet tubes are of different shape and dimensions from each other, although the outside diameter of each bayonet tube is always smaller than the inside diameter of the corresponding tube-bundle tube, so as to allow the bayonet insertion and to form said annular gap.

11. Shell-and-tube equipment according to claim 1, wherein the bayonet tubes are inserted only into a first set of tube-bundle tubes, whereas the remaining set of tube-bundle tubes is without bayonet tubes.

12. Method of controlling the outlet temperature of a first fluid from a shell-and-tube equipment at a target value by means of a bypass system, the method comprising:

inletting a first fluid into an inlet channel by a tube-side inlet nozzle provided on the inlet channel, distributing the first fluid into a plurality of tube-bundle tubes having a first open end in fluid communication with the inlet channel and a second open end in fluid communication with an outlet channel, which second open end is connected to a tube-sheet, splitting the first fluid, depending on the position of a regulating valve, into a bypass flow flowing in a plurality of bypass bayonet tubes of the bypass system and a main flow flowing in an annular gap formed in between each tube-bundle tube and the corresponding bypass bayonet tube, the bypass system comprising a box provided with an opening or conduit, the regulating valve and a box tube-sheet, wherein each bayonet tube extends from the box tube-sheet to a point in between the first open end and the second open end of the tube-bundle tubes and is partially inserted into a corresponding tube-bundle tube, the plurality of bypass bayonet tubes being in fluid communication with the box through the box tube-sheet, the box being installed inside the outlet channel, inletting a second fluid in a chamber around the tube-bundle tubes by a shell-side inlet nozzle provided on a shell sealingly enclosing the chamber, outletting the second fluid from the chamber by a shell-side outlet nozzle provided on the shell after indirect heat exchange with the first fluid through the tube-bundle tubes, discharging the main flow from the annular gap of the tube-bundle tubes into the outlet chamber at a first temperature value (T1), discharging the bypass flow from the bypass system into the outlet chamber at a second temperature value (T2) that is different from the first temperature value (T1), outletting the first fluid from the outlet channel by a tube-side outlet nozzle provided on the outlet channel at an outlet temperature (T3).

13. Method according to claim 12, wherein the first fluid is a first fluid to be cooled, the second fluid is a second cooling fluid and the second temperature value is higher than the first temperature value.

14. Method according to claim 12, comprising:

recombining the main flow and the bypass flow into a combined flow of the first fluid, which is at the outlet temperature (T3), before outletting the first fluid.

15. Method according to claim 12, wherein the amount of the main flow and the amount of the bypass flow into which the first fluid is split are regulated by the regulating valve.

16. Method according to claim 12, comprising:

adjusting the position of the regulating valve in order to modify the amount of the main flow and the bypass flow if the outlet temperature (T3) of the first fluid is not at the target value.

* * * * *